United States Patent [19]

Kayne

[11] 4,224,017

[45] Sep. 23, 1980

[54] LOCKING ARRANGEMENT FOR A CANDLE

[75] Inventor: Marvin L. Kayne, Glenwood, Ill.

[73] Assignee: Valley Candle Mfg. Co., Inc., Chicago, Ill.

[21] Appl. No.: 815,081

[22] Filed: Jul. 13, 1977

[51] Int. Cl.[3] ..... F21L 19/00

[52] U.S. Cl. ..... 431/291; 362/163

[58] Field of Search ..... 431/291, 297; 215/332; 220/293, 69, 296, 298, 297, 301; 285/394, 395, 396; 362/161, 162, 163

[56] References Cited

U.S. PATENT DOCUMENTS

| | | | |
|---|---|---|---|
| 388,894 | 9/1888 | Masson-Chevallier | 431/297 |
| 975,317 | 11/1910 | Becher | 220/301 |
| 1,609,130 | 11/1926 | Schacht | 431/297 |
| 2,997,199 | 8/1961 | Reachi | 220/69 |
| 3,285,694 | 11/1966 | Marchi | 431/291 |
| 3,672,547 | 6/1972 | Kozlowski | 220/293 |

FOREIGN PATENT DOCUMENTS

| | | | |
|---|---|---|---|
| 720627 | 12/1954 | United Kingdom | 220/293 |
| 1264666 | 2/1972 | United Kingdom | 220/293 |

*Primary Examiner*—Carroll B. Dority, Jr.
*Attorney, Agent, or Firm*—Jerome Goldberg

[57] ABSTRACT

A locking arrangement for securing a container to a base. Various bases may be used with a single container or various containers may be used with a single base. The container includes a plurality of spaced apart tongues extending outward therefrom and are received in grooves formed in retainers mounted on the inside of the base. The retainers include downward inclining edges on opposite sides of the groove.

3 Claims, 5 Drawing Figures

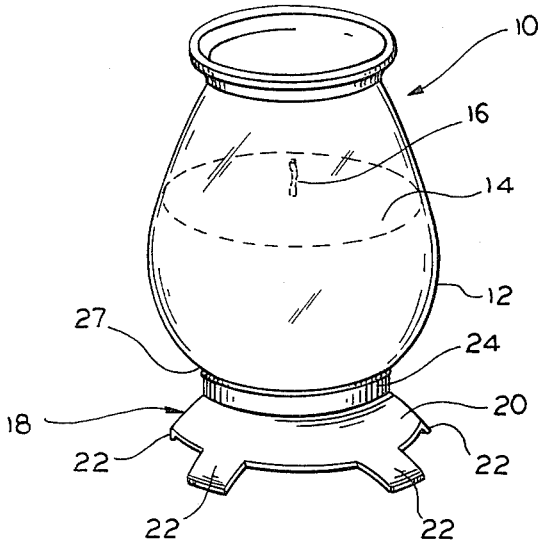
FIG.1
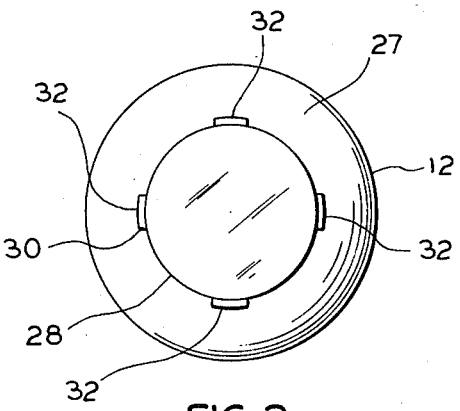
FIG.3
FIG.2
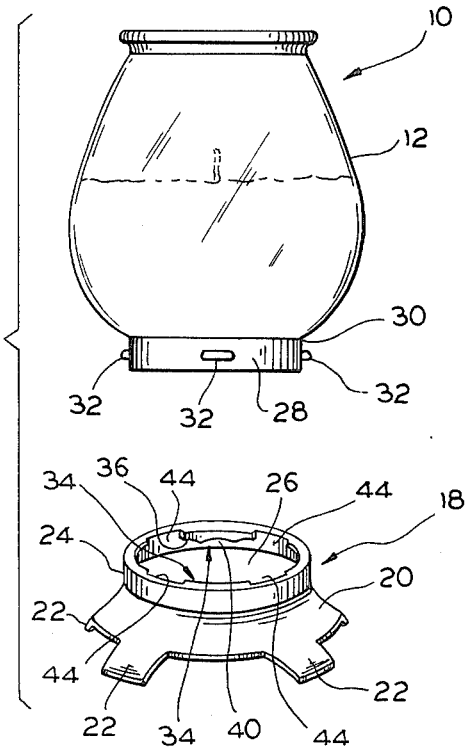
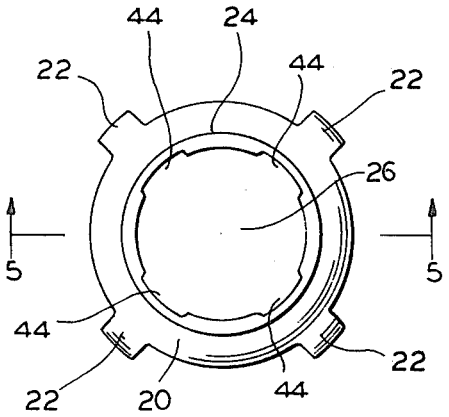
FIG.4
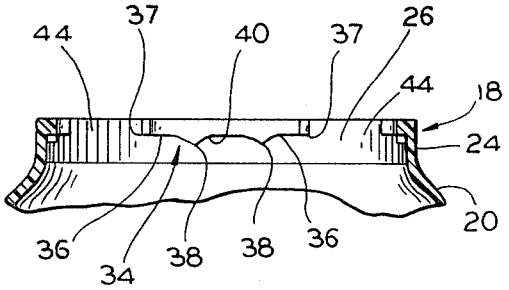
FIG.5

LOCKING ARRANGEMENT FOR A CANDLE

BACKGROUND OF INVENTION

This invention relates generally to a locking means for removably securing a container to a base, and more specifically relates to a locking means including a tongue received in a groove.

A candle comprising a container and the wax contained therein, may be placed on a flat surface and be self supporting thereon, or secured in a base and the combination placed on a flat surface. The base may provide added stability for the candle. Also, the base for candles are generally constructed to enhance the ornamental and decorative effect of the candle. The subject of the invention affords a simplified and convenient means for utilizing a single base with a plurality of candles, or a plurality of bases with a single candle. In this manner, a variety of ornamental effects could be achieved with only a minimum of component parts.

It is, therefore, a primary object of this invention to provide a locking means for removably securing a container for wax with a base.

It is another object to provide a locking means suitable for securing different designed containers to the same base, and also securing different designed bases with the same container, and thereby providing a plurality of designs by interchanging the base and/or container.

Another object is to provide a container for wax having a plurality of spaced apart tongues which are received in grooves formed in the base.

BRIEF DESCRIPTION OF THE DRAWINGS

Referring to the drawing in which the same characters of reference are employed to indicate corresponding similar parts throughout the several figures of the drawing:

FIG. 1 is a perspective view of the container positioned in the base, embodying the principles of the invention;

FIG. 2 illustrates the container spaced from the base prior to being locked thereto;

FIG. 3 is a bottom view of the container to show the four tongues protruding outward therefrom;

FIG. 4 is a top view of the base; and

FIG. 5 is an enlarged view, taken on the plane of the line 5—5 of FIG. 4, viewed in the direction indicated, and illustrating a retainer for receiving the tongue of the container.

DESCRIPTION OF THE PREFERRED EMBODIMENT

Referring now to FIGS. 1 and 2 of the drawing, the numeral 10 indicates generally a candle including a container 12 and wax 14. A wick 16 is embedded in the wax 14 and extends outward therefrom on the inside of the container 12.

The candle 10 is supported in a base 18, which comprises an annular portion 20 with four legs 22 extending downward therefrom and spaced apart a substantially equal distance. A circular collar 24 is integrally a part of the annular portion 20, protrudes upward therefrom and defines an opening 26.

The bottom portion of the container includes a neck 28 and a shoulder 30. The shoulder 30 may rest on the collar 24 when the neck 28 is positioned in the opening 26 of the collar 24. The shoulder 30 determines the depth or level that the neck 28 extends inside the opening 26.

Four tongues 32 protrude outward from the neck 28, space apart approximately ninety degrees, so that one tongue 32 is opposed to a second tongue 32. The distance from the outer tip of one tongue 32 to the outer tip of the opposed tongue 32 is slightly less than the diameter of the opening 26.

Four retainers 34 are soldered, welded or otherwise rigidly attached to the inside of the neck 28. The retainers 34 are spaced apart approximately ninety degrees, so that one retainer 34 is opposed to a second retainer 34.

Each retainer 34 includes a pair of edges 36, and each edge 36 inclines downward from a point 37 to a lower point 38. The point 38 leads into an arcuate edge 40, which arcs or curves upward to an upper surface 42 and then extends downward therefrom to the other lower point 38. The arcuate edge 40 is concave.

The tongues 32 are locked inside the space or groove 43 defined by the arcuate edge 40, when the candle 10 is operatively secured to the base 18. The tongues 32 are positioned in the space 44 between adjacent retainers 34 when the neck 28 is lowered into the opening 26. The container 12 may be turned clockwise or counter clockwise for securing the candle 10 in place. As the tongues 32 contact the downward inclining edges 36 upon rotating the container 12, the shoulder 30 of the bottom portion 28 of the container 12 tightens its association with the base 18. When the proper external force is applied to the twisting operation, the tongue 32 moves past the corresponding lower point 38 and into the space 43 defined by the arcuate edge 40. The space 43 is confining, so that the tongues 32 may either contact the arcuate edge 40 or is slightly spaced from the arcuate edge 40. The tongues 32 cannot move past the lower points 38 unless an external force is applied in the clockwise or counterclockwise direction.

The container is formed from a non-inflamable material, such as glass. The base 18 is formed from a thin plastic material which is sufficiently flexible to yield when the container 12 is rotated for locking the tongues 32 in the groove 43 of the corresponding retainer 34. Thus, the rigid glass tongues do not break off, even if the container is frequently locked and unlocked from the base. The retainer 34 is formed from a substantially more rigid and less flexible plastic material than the base 18, so that the tongues 32 make a positive association with the retainers 34, when the container 12 is locked to the base. When the container 12 is being unlocked, the flexible base 18 readily yield as the external force is applied in the clockwise or counterclockwise direction. Instead of the plastic, the base 18 may be formed from a thin flexible metal, and the retainer 34 may be formed from a more rigid metal.

The description of the preferred embodiment of the invention is intended merely as illustrative of the subject invention, the scope and limits of which are set forth in the following Claims.

I claim:

1. A candle comprising:

a glass container member including wax and a wick and having a bottom including a neck extending downward from a shoulder;

a base member having a flexible collar of thin metal or plastic extending upward and defining an opening;

a tongue extending outward from said neck;

said container, neck and tongue being an integral unit of glass, a retainer means extending inward from said collar inside said opening, said retainer means including a groove to receive said tongue when said neck is positioned in the opening and said container is rotated in the clockwise or in the counterclockwise direction, a first edge angled downward from one point to a lower point and a second edge angled downward from one point to a lower point, said first edge being on one side of the groove and said second edge being on the opposite side of the groove, for contacting the tongue prior to said tongue entering said groove, in either said clockwise or clockwise direction.

2. The candle of claim 1, wherein:

said retainer means is mounted on the collar.

3. The candle of claim 1 includes:

at least one pair of said retainer means spaced apart from each other; and at least one pair of said tongues, said tongues being dimensioned to extend inside said opening between said retainer means and being insertible in said retainer means upon being rotated either in the clockwise or counter-clockwise direction.

* * * * *